US008800297B2

(12) United States Patent
Gobrecht et al.

(10) Patent No.: US 8,800,297 B2
(45) Date of Patent: Aug. 12, 2014

(54) METHOD FOR STARTING UP A GAS AND STEAM TURBINE SYSTEM

(75) Inventors: Edwin Gobrecht, Ratingen (DE); Rainer Newald, Erlangen (DE); Erich Schmid, Marloffstein (DE)

(73) Assignee: Siemens Aktiengesellschaft, Munich (DE)

( * ) Notice: Subject to any disclaimer, the term of this patent is extended or adjusted under 35 U.S.C. 154(b) by 1440 days.

(21) Appl. No.: 11/887,868

(22) PCT Filed: Mar. 31, 2006

(86) PCT No.: PCT/EP2006/061217

§ 371 (c)(1), (2), (4) Date: Feb. 4, 2009

(87) PCT Pub. No.: WO2006/106075

PCT Pub. Date: Oct. 12, 2006

(65) Prior Publication Data

US 2009/0211259 A1 Aug. 27, 2009

(30) Foreign Application Priority Data

Apr. 5, 2005 (EP) ..... 05007416

(51) Int. Cl.
*F02C 7/26* (2006.01)
*F02C 6/18* (2006.01)

(52) U.S. Cl.
USPC ..... 60/778; 60/786; 60/39.182

(58) Field of Classification Search
USPC ..... 60/772, 786, 787, 39.182, 778
See application file for complete search history.

(56) References Cited

U.S. PATENT DOCUMENTS

| | | | | |
|---|---|---|---|---|
| 4,028,884 | A | 6/1977 | Martz et al. | |
| 5,473,898 | A * | 12/1995 | Briesch | 60/39.182 |
| 5,737,912 | A * | 4/1998 | Krakowitzer | 60/39.182 |
| 6,470,688 | B2 * | 10/2002 | Blatter et al. | 60/39.182 |
| 6,766,646 | B1 * | 7/2004 | Ford et al. | 60/646 |
| 7,621,133 | B2 * | 11/2009 | Tomlinson et al. | 60/786 |
| 2004/0045299 | A1 * | 3/2004 | Blatter et al. | 60/772 |
| 2004/0045300 | A1 * | 3/2004 | Dovali-Solis | 60/778 |
| 2004/0065089 | A1 * | 4/2004 | Liebig | 60/772 |

FOREIGN PATENT DOCUMENTS

| | | | |
|---|---|---|---|
| DE | 23 32 180 | A1 | 1/1975 |
| DE | 197 36 888 | A1 | 10/1998 |
| DE | 100 04 187 | C1 | 10/2001 |
| EP | 1 072 760 | A1 | 1/2001 |
| JP | 55064107 | A | 5/1980 |
| JP | 59093907 | A | 5/1984 |
| JP | 59221410 | A | 12/1984 |
| JP | 8284615 | A | 10/1996 |

* cited by examiner

*Primary Examiner* — Ted Kim

(57) ABSTRACT

The invention relates to a method for starting a gas and steam turbine system which comprises a gas turbine system which comprises at least one gas turbine, in addition to at least one steam turbine system which comprises at least one steam turbine and at least one steam system. Heat produced by the working fluid and which is released in the gas turbine is guided to the steam system in order to produce steam which drives the steam turbine. According to the invention, during starting, the gas turbine is started prior to the steam turbine and the steam turbine is started in the presence of the first steam in the system and is impinged upon by said steam.

4 Claims, 1 Drawing Sheet

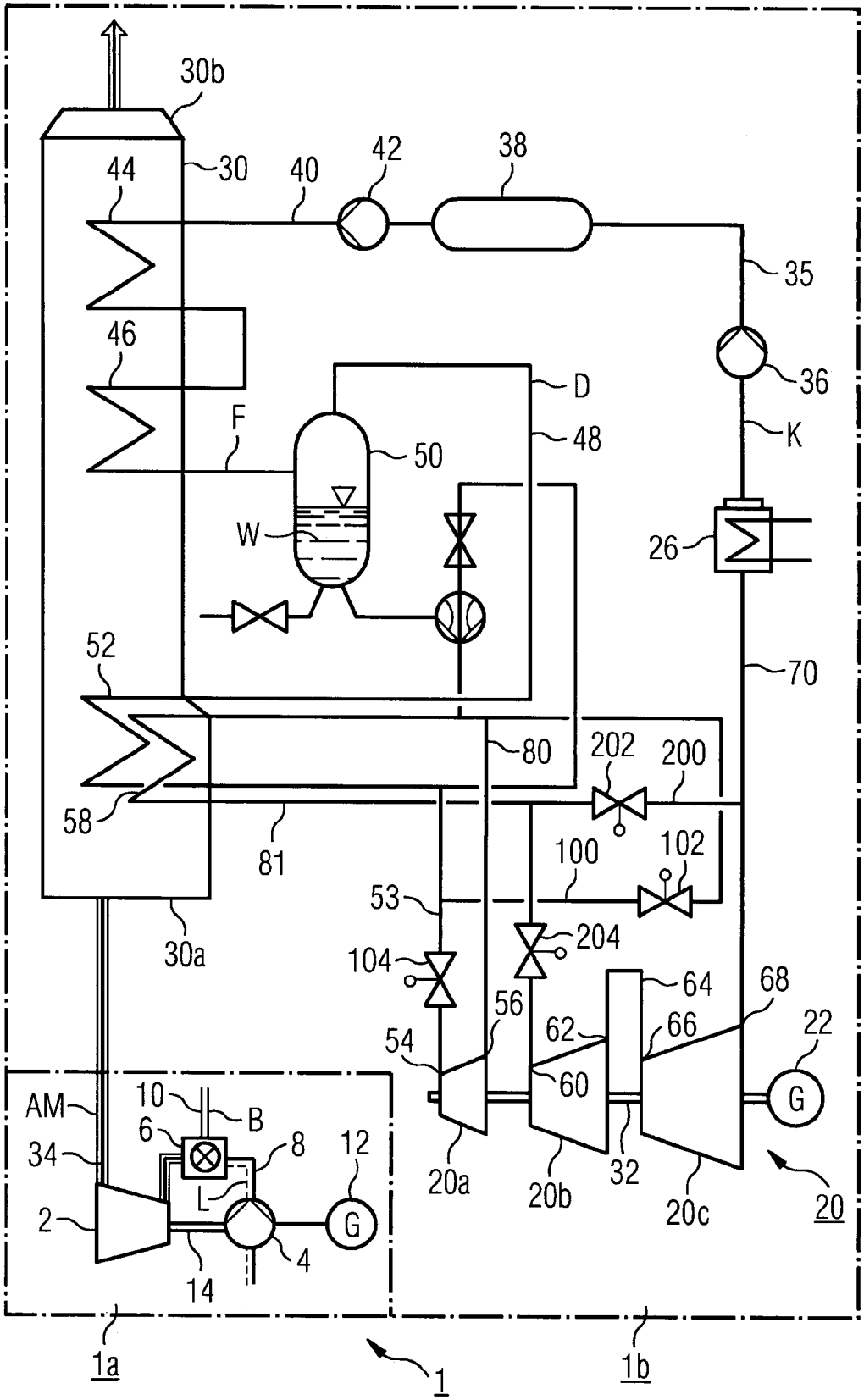
30b
30
44
40
42
38
35
46
36
D
48
F
50
K
W
26
52
70
80
202
200
58
81
100
102
53
30a
204
104
64
68
56
62
66
22
54
60
G
AM
10
B
6
8
12
34
L
20a
20b
32
20c
20
2
G
4
14
1a
1
1b

METHOD FOR STARTING UP A GAS AND STEAM TURBINE SYSTEM

CROSS REFERENCE TO RELATED APPLICATIONS

This application is the US National Stage of International Application No. PCT/EP2006/061217, filed Mar. 31, 2006 and claims the benefit thereof. The International Application claims the benefits of European application No. 05007416.0 filed Apr. 5, 2005, both of the applications are incorporated by reference herein in their entirety.

FIELD OF INVENTION

The present invention relates to a method for starting up a gas and steam turbine system, and in particular a method for a fast startup of a system of said kind.

BACKGROUND OF THE INVENTION

In a gas turbine system a gaseous or liquid fuel, for example natural gas or crude oil, is mixed with compressed air and combusted. The pressurized combustion exhaust gases are supplied to the turbine of the gas turbine system as the working medium. The working medium sets the turbines under expansion into rotation, with thermal energy being converted into mechanical work, i.e. the rotation of the turbine shaft. When the expanded working medium is discharged from the gas turbine system said medium typically still has a temperature of 500-600° Celsius.

In a gas and steam turbine system the expanded working medium, also called flue gas, from the gas turbine system is used to generate steam for driving a steam turbine. Toward that end the working medium is supplied to a heat recovery steam generator connected downstream of the gas turbine system on the exhaust gas side, in which steam generator heating surfaces are arranged in the form of pipes or pipe bundles. Said heating surfaces are in turn connected into a water-steam cycle of the steam turbine system which has at least one, but mostly a plurality of pressure stages. The pressure stages differ from one another in that the water supplied to the heating surface for the purpose of generating steam has different pressure levels. A gas and steam turbine system comprising a water-steam cycle having only one pressure stage is described in DE 197 36 888 A1, and such a system comprising three pressure stages, namely a high-pressure stage, a medium-pressure stage and a low-pressure stage, is described in DE 100 04 187 C1.

Currently, in order to start a gas and steam turbine system, the gas turbine system is usually started up and the expanded working medium is supplied to the heat recovery steam generator of the steam turbine system. Initially, however, the steam generated in the heat recovery steam generator is not fed to the turbine part of the steam turbine system, but is directed past the turbine via diverter stations and supplied directly to a condenser which condenses the steam to water. The condensate is then supplied to the steam generator again as feedwater. In many embodiment variants of gas and steam turbine systems the diverted steam is also conveyed to the atmosphere.

The steam turbine is only switched into the cycle when certain steam parameters in the steam lines of the water-steam cycle or in the steam lines leading to the turbine part of the gas turbine system, for example certain steam pressures and temperatures, are complied with. Complying with said steam parameters is designed to keep potential stresses in thick-walled components at a low level.

After the startup of the gas turbine system there is a power increase which leads to an increase in pressure in the steam system. The load gradient at which the gas turbine system is started up, i.e. the power increase of the gas turbine system per time unit, is critically dependent on the implementation and mode of construction of the heat recovery steam generator as well as on the structural limitations within the steam turbine. As the gas turbine load and consequently the temperature or, as the case may be, the volume flow rate of the exhaust gas emitted from the gas turbine system increase, the steam temperature and the pressure in the steam system are also increased.

Before the steam turbine starts up, the gas turbine is typically kept at a specific partial load until stationary states have come about in the gas turbine system and in the steam system. As soon as stable steam production has been reached, the steam contained in the steam system is channeled to the steam turbine, thereby accelerating the steam turbine. The turbine speed is then increased to nominal speed. Following synchronization of the generator coupled to the steam turbine with the power supply system, or in the case of single-shaft systems, following the engagement of the overrunning clutch, the steam turbine is subjected to further load as a result of an increase in the steam supply. At the same time the diverter stations close more and more in order to keep the steam pressure roughly constant and minimize level fluctuations in the heat recovery steam generator.

As soon as the diverter stations are closed and the steam produced in the heat recovery steam generator is channeled in its entirety to the steam turbine, a further increase in the gas turbine power output takes place when there is a higher power requirement on the part of the system which is now operating in the gas and steam turbine mode.

By definition, the startup operation of a gas and steam turbine system is terminated only when the gas turbine has reached the base load and all diverter stations are closed.

SUMMARY OF INVENTION

The object of the present invention is to provide a method for starting up a gas and steam turbine system which enables a faster startup operation than the method described in the introduction.

This object is achieved by means of a method for starting up a gas and steam turbine system as claimed in the claims. The dependent claims contain advantageous embodiments of the method.

According to the invention, a method is provided for starting up a gas and steam turbine system, in particular for fast starting up of a gas and steam turbine system which has a gas turbine system comprising at least one gas turbine as well as a steam turbine system having at least one steam turbine and at least one steam system and in which the waste heat of a working medium expanding in the gas turbine is supplied to the steam system for the purpose of generating the steam driving the steam turbine.

In the method according to the invention, at startup time the gas turbine is started first, before the steam turbine is started. The steam turbine is then already started up when the first steam is present in the steam system and is impinged upon by steam.

In the method according to the invention, the steam turbine is started up at the earliest possible time and accelerated by means of the first steam from the heat recovery steam generator, without waiting for stationary states in the steam system. This measure enables the startup operation of the gas and steam turbine system to be shortened considerably.

In contrast to the usual startup method, the steam temperature in the steam system at the time of starting the steam turbine can be less than the material temperature of the steam turbine or of its housing. The early channeling of the steam to the steam turbine can therefore lead to a cooling down of the components and to thermal stresses. However, a certain compensation can be achieved if the gradients are kept correspondingly low during the following increase in the steam temperatures.

Advantageously, the tuning of the steam system during the startup operation is chosen in such a way that the steam pressure increases continuously. This can be achieved, for example, by opening a steam diverter station of the steam system only so wide that a minimum steam quantity required for accelerating and/or synchronizing the steam turbine is generated using a part of the waste heat of the working medium and a pressure increase in the steam system is produced by means of the remaining part of the waste heat of the working medium.

In addition to a pressure increase in the steam system, the comparatively small opening of the steam diverter station leads to a reduction in the steam production in the heat recovery steam generator. As a result the thermal load to the condenser is reduced and the diverter station can close more quickly.

In a special embodiment of the method according to the invention the diverter station is not opened at all.

The method according to the invention can be embodied in particular in such a way that the gas turbine system experiences a load increase during the entire startup operation, in particular until the base load is reached. In other words, the method dispenses with keeping the gas turbine system at a certain partial load and waiting until the gas turbine system and the steam system of the steam turbine system have settled into stationary states. This measure also leads to a reduction in the startup time of the gas turbine system and thus enables a fast startup.

In a special embodiment the gas turbine system's load is increased at maximum load ramp, which is to say that there is a maximum increase in the gas turbine power output per time unit.

The gas and steam turbine system during the starting up of the gas turbine system to base load is preferably switched over into the gas and steam turbine operating mode, with the result that the startup operation is, by definition, terminated when the gas turbine base load is reached. The switchover into the gas and steam turbine operating mode can include in particular the synchronization of a generator coupled to the steam turbine with the power supply system or, in the case of single-shaft systems, the engagement of the automatic overrunning clutch.

The described method according to the invention for starting up a gas and steam turbine system shortens the startup time of the system considerably. Compared with the method described in the introduction, a reduction in the starting time by approximately 50% is achievable. A gas and steam turbine operator can therefore respond very flexibly to short-term requirements, as a result of which the revenues from the purchase of power can be increased. As a result of the early steam takeover of the steam turbine and the reduced thermal load in the condenser, which leads to smaller power losses, there is also an increase in the averaged efficiency of the gas and steam turbine system, which is a significant factor in particular in the case of frequent starts and increases the cost-effectiveness of the system.

Moreover, the lower steam production in the method according to the invention for starting up a gas and steam turbine system also enables smaller diverter stations to be installed, thereby reducing investment costs.

The described startup method enabling a fast startup of a gas and steam turbine system can essentially be realized by means of software modifications. It is therefore also possible to convert existing gas and steam turbine systems to the startup method according to the invention.

BRIEF DESCRIPTION OF THE DRAWINGS

Further features, characteristics and advantages of the present invention will emerge from the following description of an exemplary embodiment with reference to the accompanying FIGURE.

FIG. 1 shows a schematic diagram for a gas and steam turbine system.

DETAILED DESCRIPTION OF INVENTION

The gas and steam turbine system 1 represented schematically in FIG. 1 comprises a gas turbine system 1*a* as well as a steam turbine system 1*b*. The gas turbine system 1*a* is equipped with a gas turbine 2, a compressor 4, and at least one combustion chamber 6 connected between the compressor 4 and the gas turbine 2. By means of the compressor 4, fresh air L is drawn in, compressed and supplied via the fresh air line 8 to one or more burners of the combustion chamber 6. The supplied air is mixed with liquid or gaseous fuel B fed via a fuel line 10 and the mixture ignited. The resulting combustion exhaust gases form the working medium AM of the gas turbine system 1*a*, which working medium AM is supplied to the gas turbine 2, where it produces work under expansion and drives a shaft 14 coupled to the gas turbine 2. The shaft 14 is coupled not only to the gas turbine 2 but also to the air compressor 4 as well as to a generator 12 in order to drive the latter. The expanded working medium AM is conducted via an exhaust gas line 34 to a heat recovery steam generator 30 of the steam turbine system 1*b*.

In the heat recovery steam generator 30 the working medium output by the gas turbine 1*a* at a temperature of approx. 500-600° Celsius is used for generating and superheating steam.

In addition to the heat recovery steam generator 30, which can be embodied in particular as a once-through, forced-flow system, the steam turbine system 1*b* comprises a steam turbine 20 having turbine stages 20*a*, 20*b*, 20*c* and a condenser 26. The heat recovery steam generator 30 and the condenser 26, in combination with condensate lines and feedwater lines 35, 40 as well as steam lines 48, 53, 64, 70, 80, 100, form a steam system which, together with the steam turbine 20, forms a water-steam cycle.

Water from a feedwater reservoir 38 is supplied by means of a feedwater pump 42 to a high-pressure preheater 44, also known as an economizer, and from there is forwarded to an evaporator 46 which is designed for once-through operation and is connected to the economizer 44 on the output side. For its part, the evaporator 46 is in turn connected on the output side to a superheater 52 via a steam line 48 into which a water separator 50 is inserted. The superheater 52 is connected on the output side via a steam line 53 to the steam input 54 of the high-pressure stage 20*a* of the steam turbine 20.

In the high-pressure stage 20*a* of the steam turbine 20, the superheated steam from the superheater 52 drives the turbine before it is passed on via the steam output 56 of the high-pressure stage 20*a* to an intermediate superheater 58.

After being superheated in the intermediate superheater 58, the steam is forwarded via a further steam line 81 to the steam input 60 of the medium-pressure stage 20*b* of the steam turbine 20, where it drives the turbine.

The steam output 62 of the medium-pressure stage 20*b* is connected via an overflow line 64 to the steam inlet 66 of the low-pressure stage 20*c* of the steam turbine. After flowing through the low-pressure stage 20*c* and the driving of the turbine associated therewith, the cooled and expanded steam is output via the steam output 68 of the low-pressure stage 20*c* to the steam line 70, which leads it to the condenser 26.

The condenser 26 converts the incoming steam into condensate and forwards the condensate by means of a condensate pump 36 to the feedwater reservoir 38 via the condensate line 35.

In addition to the already mentioned elements of the water-steam cycle, the latter also comprises a bypass line 100, what is referred to as the high-pressure diverter line, which branches off from the steam line 53 before the latter reaches the steam inlet 54 of the high-pressure stage 20*a*. The high-pressure bypass line 100 bypasses the high-pressure stage 20*a* and flows into the feed line 80 to the intermediate superheater 58. A further bypass line, referred to as the medium-pressure bypass line 200, branches from the steam line 81 before the latter flows into the steam inlet 60 of the medium-pressure stage 20*b*. The medium-pressure bypass line 200 bypasses both the medium-pressure stage 20*b* and the low-pressure stage 20*c* and flows into the steam line 70 leading to the condenser 26.

Incorporated into the high-pressure bypass line 100 and the medium-pressure bypass line 200 are the shutoff valves 102, 202, by means of which said lines can be shut off. Shutoff valves 104, 204 are also included in the steam line 53 and in the steam line 81, in each case between the branching-off point of the bypass line 100 and 200, respectively, and the steam inlet 54 of the high-pressure stage 20*a* and the steam inlet 60 of the medium-pressure stage 20*a*, respectively.

Incorporated into the medium-pressure bypass line 200 is a shutoff valve 202 by means of which said line can be shut off. A shutoff valve 104 is also included in the steam line 53, namely between the branching-off point of the bypass line 100 and the steam inlet 54 of the high-pressure stage 20*a* of the steam turbine 20.

The bypass line 100 and the shutoff valves 102, 104 are used during the starting up of the gas and steam turbine system 1 to divert a part of the steam for the purpose of bypassing the steam turbine 2. It is possible for at least one diverter station 100, 102, 200, to be opened only so wide that a minimum steam quantity required for accelerating and/or synchronizing the steam turbine 20 is generated by a part of the waste heat of the working medium and an increase in pressure is produced in the steam system by the remainder of the waste heat of the working medium It is further possible that no diverter station 100, 102, 200, 202 leading to a bypassing of the steam turbine is opened in the steam system.

An exemplary embodiment of the method according to the invention for starting up a gas and steam turbine system is described below based on the system 1 described with reference to FIG. 1.

At the start of the method the gas turbine system 1*a* is started and the working medium AM being discharged from the system is supplied to the heat recovery steam generator 30 via an input 30*a*. The expanded working medium AM flows through the heat recovery steam generator 30 and exits the latter via an output 30*b* in the direction of a vent stack (not shown in FIG. 1). As the working medium AM flows through the heat recovery steam generator 30, heat is transferred from the working medium AM to the water or steam in the water-steam cycle.

After the gas turbine system has been started up, the waste heat of the working medium in the heat recovery steam generator 30 leads to the start of steam production in the steam system.

In this early phase of the startup operation the shutoff valves 102 and 104 or 202 and 204 are set in such a way that only a small part of the generated steam flows through the bypass lines 100, 200 and already in this phase of the startup operation the majority of the steam is supplied to the steam turbine 20. The part of the steam supplied to the steam turbine 20 accelerates the steam turbine and preheats the latter insofar as the steam is hotter than the material of the turbine and the steam lines.

Since only a small amount of steam flows directly to the condenser 26 via the medium-pressure bypass line 200, the waste heat not used during the acceleration and preheating of the steam turbine 20 leads to a pressure increase in the steam system. In the further course of the startup operation the steam pressure therefore increases continuously in the steam system, as a result of which steam production in the heat recovery steam generator is reduced. This leads to a reduction in the heat input into the condenser 26 and as a result the shutoff valves 102 and 202, which are not fully open anyway, can be closed quickly compared to prior art starting methods.

Once the gas turbine system 1*a* has been started, the load of the gas turbine system is increased preferably at maximum load ramp until the base load is reached.

If the steam temperature is less than the material temperature of the turbine 20 at the start of the introduction of steam into the steam turbine 20, the steam temperature will steadily increase during the startup of the load of the gas turbine system and relatively soon exceed the material temperature of the steam turbine and the lines leading thereto. If the rapid rise from a relatively cool temperature of the turbine components to a high temperature would exceed a certain predefined limit of the thermal stresses in the material due to the starting up of the gas turbine system at maximum load ramp, the power output of the gas turbine system can also be increased at a lower ramp than the maximum load ramp, with the result that the steam temperatures rise more slowly.

Since the bypass lines 100, 200 are closed at an early stage in the startup method according to the invention and the gas and steam turbine system 1 is switched over into the gas and steam turbine operating mode already during the starting up of the gas turbine system 1*a* to base load, the startup operation is terminated when the gas turbine base load is reached.

Even if the steam turbine load were to reach only a magnitude of approximately 80-90% when the gas turbine base load is reached, the startup operation is deemed to be completed according to the definition whereby the startup operation is terminated when the base load of the gas turbine system is reached and the bypass lines are closed. Depending on the dynamic characteristics of the heat recovery steam generator, a further pressure increase will take place over several minutes and will be completed after approximately 10-20 further minutes. The amount of steam will increase accordingly, and steam turbine power output ratings in excess of 95% will be achieved as a function of steam temperature.

The startup method according to the invention has been described with reference to a gas and steam turbine system comprising a water-steam cycle which has only one pressure stage. It should, however, be pointed out at this juncture that the method according to the invention can also be applied in the case of gas and steam turbine systems which have more than one pressure stage in the water-steam cycle. A gas and steam turbine system comprising three pressure stages, namely a high-pressure stage, a medium-pressure stage and a low-pressure stage in the water-steam cycle, for which the startup method according to the invention can also be used, is described for example in DE 100 04 187 C1, to which reference is made in relation to the embodiment of a gas and steam turbine system comprising a plurality of pressure stages.

The invention claimed is:

1. A method for starting up a gas and steam turbine system having a gas turbine system containing a gas turbine and a steam turbine system containing a steam turbine and a steam system, comprising:

supplying a waste heat of a working medium of the gas turbine to the steam system to produce steam for driving the steam turbine; and starting up and accelerating the steam turbine when a first steam is present in the steam system via impingement of the first steam upon the turbine;

wherein the first steam is generated in the steam system by the waste heat from the gas turbine, wherein the steam turbine is started with the first steam at the earliest possible time without waiting for stationary states in the steam system, wherein during the startup operation the steam system is tuned such that the steam pressure increases continuously, and wherein the steam system is tuned via at least one steam diverter station of the steam system, and no diverter station leading to a bypassing of the steam turbine is opened in the steam system during the entire system startup.

2. The method as claimed in claim 1, wherein the gas turbine system experiences an increase in load during the entire system startup, and wherein the increase in load is maintained until a base load of the gas turbine system has been reached.

3. The method as claimed in claim 2, wherein the gas and steam turbine system is switched over into a gas and steam turbine operating mode during the increase in load.

4. A method for starting up a gas and steam turbine system having a gas turbine system containing a gas turbine and a steam turbine system containing a steam turbine and a steam system, comprising:

supplying a waste heat of a working medium of the gas turbine to the steam system to produce steam for driving the steam turbine; and starting up and accelerating the steam turbine when a first steam is present in the steam system via impingement of the first steam upon the turbine;

wherein the first steam is generated in the steam system by the waste heat from the gas turbine, wherein the steam turbine is started with the first steam at the earliest possible time without waiting for stationary states in the steam system, and wherein the steam system is tuned via at least one steam diverter station of the steam system, and the diverter station is only opened enough to bypass a minority of the first steam while a majority of the first steam is supplied to the steam turbine.

* * * * *